US007367866B2

(12) United States Patent
Jeong

(10) Patent No.: US 7,367,866 B2
(45) Date of Patent: May 6, 2008

(54) APPARATUS AND METHOD FOR POLISHING SEMICONDUCTOR WAFERS USING PIVOTABLE LOAD/UNLOAD CUPS

(75) Inventor: In Kwon Jeong, Cupertino, CA (US)

(73) Assignee: InoPla Inc, San Jose, CA (US)

( * ) Notice: Subject to any disclaimer, the term of this patent is extended or adjusted under 35 U.S.C. 154(b) by 111 days.

(21) Appl. No.: 11/208,158

(22) Filed: Aug. 18, 2005

(65) Prior Publication Data

US 2006/0046617 A1 Mar. 2, 2006

Related U.S. Application Data

(60) Provisional application No. 60/605,698, filed on Aug. 30, 2004.

(51) Int. Cl.
*B24B 51/00* (2006.01)

(52) U.S. Cl. ..... 451/5; 451/41

(58) Field of Classification Search ..... 451/5, 451/288, 287, 289, 41, 57
See application file for complete search history.

(56) References Cited

U.S. PATENT DOCUMENTS

| | | | | |
|---|---|---|---|---|
| 7,229,339 | B2 * | 6/2007 | Stumpf et al. | 451/8 |
| 2003/0003852 | A1 * | 1/2003 | Jeong | 451/56 |
| 2005/0227595 | A1 * | 10/2005 | Marquardt et al. | 451/285 |
| 2005/0230354 | A1 * | 10/2005 | Hardikar | 216/88 |
| 2006/0003671 | A1 * | 1/2006 | Stumpf et al. | 451/5 |

* cited by examiner

*Primary Examiner*—Robert Rose
(74) *Attorney, Agent, or Firm*—Thomas H. Ham; Wilson & Ham

(57) ABSTRACT

An apparatus and method for polishing objects, such as semiconductor wafers, utilizes pivotable load/unload cups to transfer the objects to object carriers to polish the objects on at least one polishing surface. The pivoting axes of the pivotable load/unload cups are located between the object carriers.

19 Claims, 11 Drawing Sheets

APPARATUS AND METHOD FOR POLISHING SEMICONDUCTOR WAFERS USING PIVOTABLE LOAD/UNLOAD CUPS

CROSS REFERENCE TO RELATED APPLICATION

This application is entitled to the benefit of U.S. Provisional Patent Application Ser. No. 60/605,698, filed on Aug. 30, 2004, which is incorporated herein by reference.

FIELD OF THE INVENTION

The invention relates generally to semiconductor processing equipments, and more particularly to an apparatus and method for polishing semiconductor wafers.

BACKGROUND OF THE INVENTION

Local and global planarization of semiconductor wafers becomes increasingly important as more metal layers and interlayer dielectric layers are stacked on the wafers. A preferred method to planarize semiconductor wafers is the chemical mechanical polishing (CMP) method, where a surface of a semiconductor wafer is polished using a slurry solution supplied between the wafer and a polishing pad. The CMP method is also widely used for damascene process to form copper structures on the semiconductor wafers.

In general, a CMP equipment includes a polishing table where a polishing pad is placed and a wafer carrier that supports a semiconductor wafer and presses the wafer against the polishing pad. One of the most important performances of a CMP equipment is productivity. For higher productivity, a CMP equipment typically requires more polishing tables and more wafer carriers. In order to use more polishing tables and more wafer carriers efficiently, it is important to transfer the semiconductor wafers to and from the wafer carriers efficiently so that the wafer carriers can receive fresh wafers with least amount of idle time after they unload polished wafers. The reduced idle time of the wafer carriers contributes to high productivity of the CMP equipment.

In view of these issues, what is needed is an apparatus and method for polishing semiconductor wafer with highly efficient wafer transfer devices.

SUMMARY OF THE INVENTION

An apparatus and method for polishing objects, such as semiconductor wafers, utilizes pivotable load/unload cups to transfer the objects to object carriers to polish the objects on at least one polishing surface. The pivoting axes of the pivotable load/unload cups are located between the object carriers. The use of the pivotable load/unload cups allows for more efficient processing of the objects to polish the objects on at least one polishing surface.

An apparatus for polishing objects in accordance with an embodiment of the invention comprises at least one polishing surface, a first object carrier positioned over the at least one polishing surface, a second object carrier positioned over the at least one polishing surface, a first object relay device and a second object relay device. The first object relay device includes a first load/unload cup. The first object relay device is configured to independently pivot the first load/unload cup about a first axis to at least one of the first and second object carriers to transfer at least some of the objects between the first load/unload cup and at least one of the first and second object carriers. The first axis is located between the first and second object carriers. The second object relay device includes a second load/unload cup. The second object relay device is configured to independently pivot the second load/unload cup about a second axis to at least one of the first and second object carriers to transfer at least some of the objects between the second load/unload cup and at least one of the first and second object carriers. The second axis is located between the first and second object carriers.

A method for polishing objects in accordance with an embodiment of the invention comprises independently pivoting a first load/unload cup about a first axis to at least one of first and second object carriers to transfer at least some of the objects between the first load/unload cup and at least one of the first and second object carriers, independently pivoting a second load/unload cup about a second axis to at least one of the first and second object carriers to transfer at least some of the objects between the second load/unload cup and at least one of the first and second object carriers, polishing at least some of the objects on at least one polishing surface using the first object carrier, and polishing at least some of the objects on the at least one polishing surface using the second object carrier. The first and second axes are located between the first and second object carriers.

Other aspects and advantages of the present invention will become apparent from the following detailed description, taken in conjunction with the accompanying drawings, illustrated by way of example of the principles of the invention.

DETAILED DESCRIPTION

Figure 1:
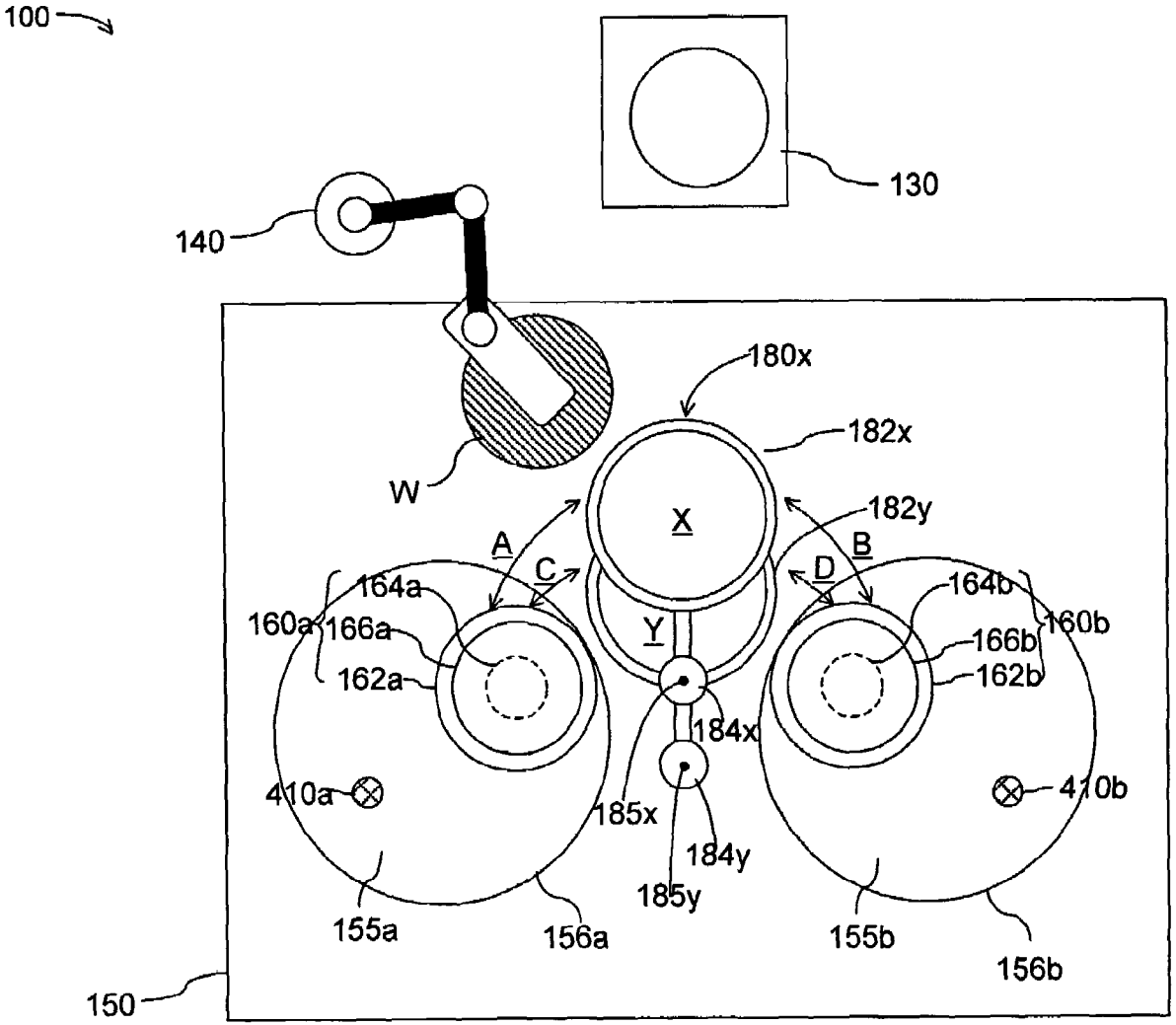
FIG. 1 is a top view of a polishing apparatus in accordance with an embodiment of the present invention.

With reference to FIG. 1, a polishing apparatus 100 in accordance with an embodiment of the present invention is described. FIG. 1 is a top view of the polishing apparatus 100. The polishing apparatus 100 can be used to perform chemical mechanical polishing (CMP) on objects, such as semiconductor wafers. The polishing apparatus 100 is designed to efficiently process semiconductor wafers to increase the throughput of the apparatus.

As shown in FIG. 1, the polishing apparatus 100 comprises a wafer input station 130, a wafer transport device 140 and a polishing unit 150. The wafer input station 130 accommodates semiconductor wafers or other comparable objects to be polished by the polishing apparatus 100. The wafer input station 130 can also accommodate semiconductor wafers that have been polished by the polishing apparatus 100. The wafer transport device 140 transports wafers between the wafer input station 130 and the polishing unit 150, as described in more detail below. As an example, the wafer transport device 140 may comprise a robotic arm to handle a wafer for transport.

Figure 3:
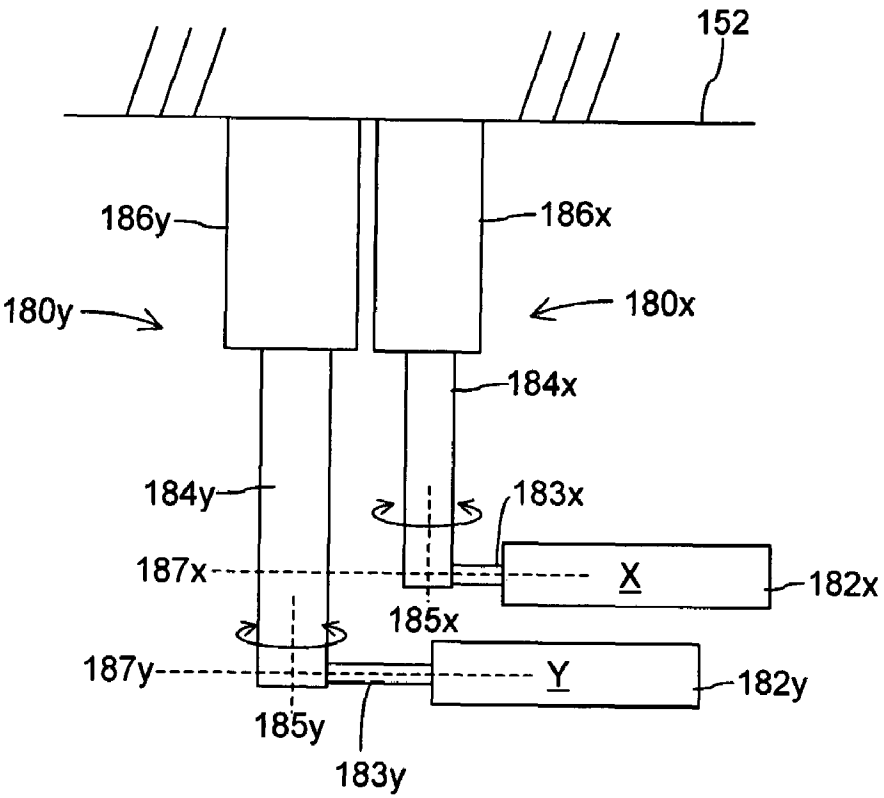
FIG. 3 is a side view of wafer relay devices of the polishing unit of FIG. 1.
Figure 2:
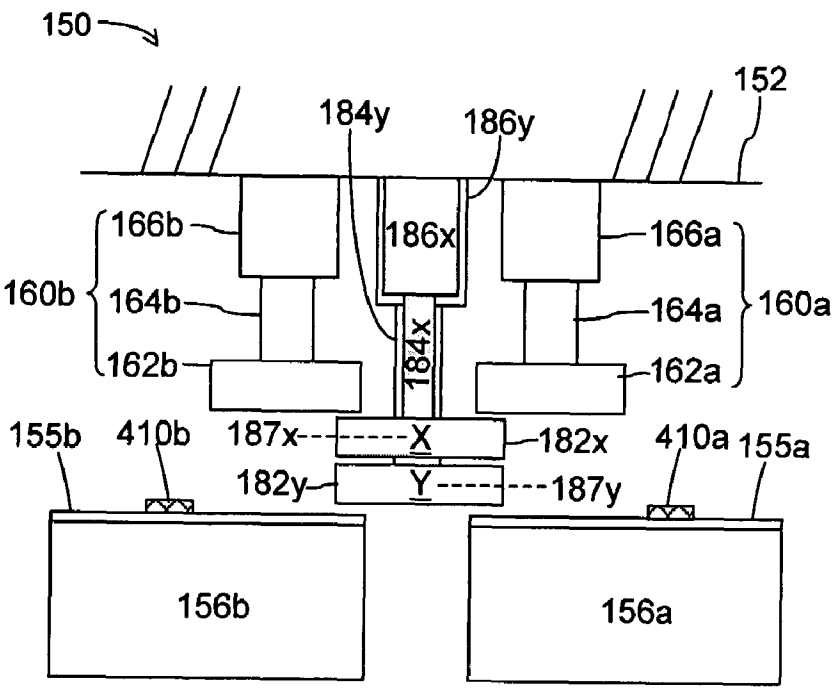
FIG. 2 is a front view of the polishing unit of the polishing apparatus of FIG. 1.

With reference to FIGS. 1, 2 and 3, the polishing unit 150 in accordance with an embodiment of the invention is described. FIG. 2 is a front view of the polishing unit 150 and FIG. 3 is a side view of wafer relay devices 180*x* and 180*y* of the polishing unit 150. The polishing unit 150 comprises a first polishing table 156*a*, a second polishing table 156*b*, a first wafer carrier assembly 160*a*, a second wafer carrier assembly 160*b*, the first wafer relay device 180*x* and the second wafer relay device 180*y*.

Each of the polishing tables 156*a* and 156*b* can be rotated or orbited about an axis. Polishing pads 155*a* and 155*b* may be attached onto the polishing tables 156*a* and 156*b*, respectively. The polishing pads 155*a* and 155*b* provide polishing surfaces to perform CMP process on semiconductor wafers, which involves using one or more slurries containing abrasive particles and/or chemicals such as KOH with the polishing pads 155*a* and 155*b* to polish semiconductor wafers. Pad conditioners 410*a* and 410*b* may be used to condition the surfaces of the polishing pads 155 during the CMP process to refresh the surfaces of the polishing pads 155*a* and 155*b* for proper polishing.

The wafer carrier assemblies 160*a* and 160*b* are positioned over the polishing pads 155*a* and 155*b*, respectively. Each of the wafer carrier assemblies 160*a* and 160*b* comprises a wafer carrier 162, a carrier shaft 164 and a rotating-and-vertical drive mechanism 166. The wafer carrier 162 is designed to hold a semiconductor wafer such that the surface of the wafer to be polished is faced toward the respective polishing pad 155*a* or 155*b*. The wafer carrier 162 is connected to the rotating-and-vertical drive mechanism 166 through the carrier shaft 164. The rotating-and-vertical drive mechanisms 166*a* and 166*b* are mounted to an upper surface 152 of a housing of the polishing unit 150. The upper housing surface 152 is positioned above the polishing pads 155*a* and 155*b*. The rotating-and-vertical drive mechanism 166 controls the rotational and vertical motions of the respective wafer carrier 162 through the connected carrier shaft 164. Thus, the rotating-and-vertical drive mechanism 166 is configured to rotate the respective wafer carrier 162 by rotating the connected carrier shaft 164 and to vertically move the respective wafer carrier by vertically moving the connected carrier shaft. Consequently, the wafer carrier 162 can be moved between its polishing position on the respective polishing table 156 and its wafer load/unload position over that polishing table 156, which is above its polishing position. In order to polish semiconductor wafers, the wafer carriers 162*a* and 162*b* are moved down to the respective polishing positions on the respective polishing pads 155*a* and 155*b* by the respective rotating-and-vertical drive mechanisms 166*a* and 166*b* to press the wafers held by the wafer carriers onto the respective polishing pads.

Each of the wafer relay devices 180*x* and 180*y* comprises a load/unload cup 182, a pivoting arm 183, a pivoting shaft 184 and a pivoting-and-vertical drive mechanism 186. The load/unload cup 182 is connected to the pivoting shaft 184 through the pivoting arm 183. The pivoting shaft 184 is connected to the pivoting-and-vertical drive mechanism 186. The center of the pivoting shaft 184 is the pivoting axis 185 for this wafer relay device 180*x* or 180*y*. In an embodiment, the pivoting-and-vertical drive mechanism 186 is mounted to the upper housing surface 152 of the polishing unit 150, as illustrated in FIG. 2. The pivoting-and-vertical drive mechanism 186 controls pivoting and vertical motions of the load/unload cup 182 through the pivoting shaft 184 and the pivoting arm 183. Thus, each of the pivoting-and-vertical drive mechanisms 186*a* and 186*b* is configured to pivot the respective load/unload cup 182 through the connected pivoting shaft 184 and to vertically move the respective load/unload cup through the connected pivoting shaft.

In FIGS. 1, 2 and 3, the positions X and Y of the first and second load/unload cups 182*x* and 182*y* are their respective parking positions. The load/unload cups 182*x* and 182*y* are designed to receive wafers from the wafer transport device 140 at the parking positions X and Y, respectively. The first load/unload cup 182*x* can be pivoted about the pivoting axis 185*x* from the parking position X to one or both of the wafer load/unload positions of the first and second wafer carriers 162*a* and 162*b*, as illustrated in FIG. 1 by pivoting motions A and B, respectively. Similarly, the second load/unload cup 182*y* can be pivoted about the pivoting axis 185*y* from the parking position Y to one or both of the wafer load/unload positions of the first and the second wafer carriers 162*a* and 162*b*, as illustrated by pivoting motions C and D, respectively. As shown in FIG. 1, the pivoting axes 185*x* and 185*y* of the wafer relay devices 180*x* and 180*y*, respectively, are located between the polishing tables 156*a* and 156*b* and between the wafer carriers 162*a* and 162*b*.

To horizontally align the first load/unload cup 182*x* to one of the first and second wafer carriers 162*a* and 162*b* for wafer load/unload, the first wafer relay device 180*x* is designed and positioned in such a manner that the distance from the center of the first pivoting shaft 184*x*, i.e., the pivoting axis 185*x*, to the center of the first load/unload cup 182*x* is substantially equal to the distance from the center of the pivoting shaft 184*x* to the center of the first wafer carrier 162*a* and to the distance from the center of the pivoting shaft 184*x* to the center of the second wafer carrier 162*b*. In a similar manner, the second wafer relay device 180*y* is designed and positioned in such a manner that the distance from the center of the second pivoting shaft 184*y*, i.e., the pivoting axis 185*y*, to the center of the second load/unload cup 182*y* is substantially equal to the distances from the center of the pivoting shaft 184*y* to the centers of the first and second wafer carriers 162*a* and 162*b*. Furthermore, the load/unload cups 182*x* and 182*y* can be vertically aligned to the wafer carriers 162*a* and 162*b* at their wafer load/unload positions for loading and unloading of semiconductor wafers by vertical motions of the load/unload cups 182*x* and 182*y*. It is also possible to vertically align the wafer carriers 162*a* and 162*b* to the load/unload cups 182*x* and 182*y* by vertical motions of the wafer carriers.

The two wafer relay devices 180$x$ and 180$y$ can be positioned between the two wafer carriers 162 of the polishing unit 620 such that the first load/unload cup 182$x$ is positioned over the second load/unload cup 182$y$ at their respective parking positions X and Y as illustrated in FIGS. 1 and 2. As illustrated in FIGS. 2 and 3, the first load/unload cup 182$x$ can be pivoted about the pivoting axis 185$x$ on a plane 187$x$, while the second load/unload cup 182$y$ can be pivoted about the pivoting axis 185$y$ on a plane 187$y$. The planes 187$x$ and 187$y$ are parallel to each other, as well as to the polishing surfaces of the polishing tables 156$a$ and 156$b$. Thus, the plane 187$y$ is closer to the polishing surfaces of the polishing tables 156$a$ and 156$b$ than the plane 187$x$. However, in an alternative embodiment, the wafer relay devices 180$x$ and 180$y$ may be configured such that the plane 187$x$ is closer to the polishing surfaces of the polishing tables 156$a$ and 156$b$ than the plane 187$y$.

Figure 10B:
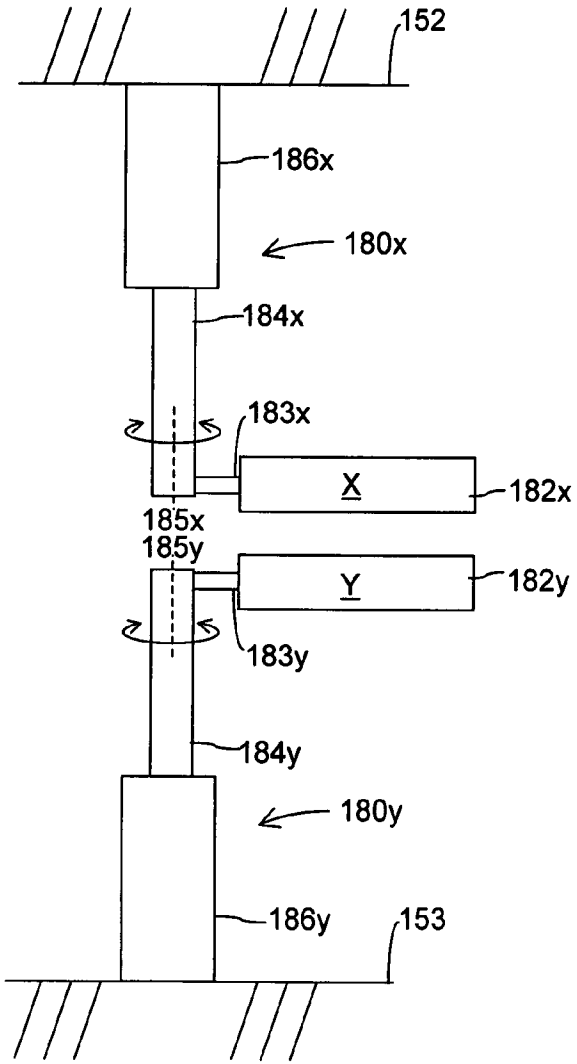
FIGS. 10(*a*) and 10(*b*) are side views of wafer relay devices in accordance with other embodiments of the present invention.
Figure 10A:
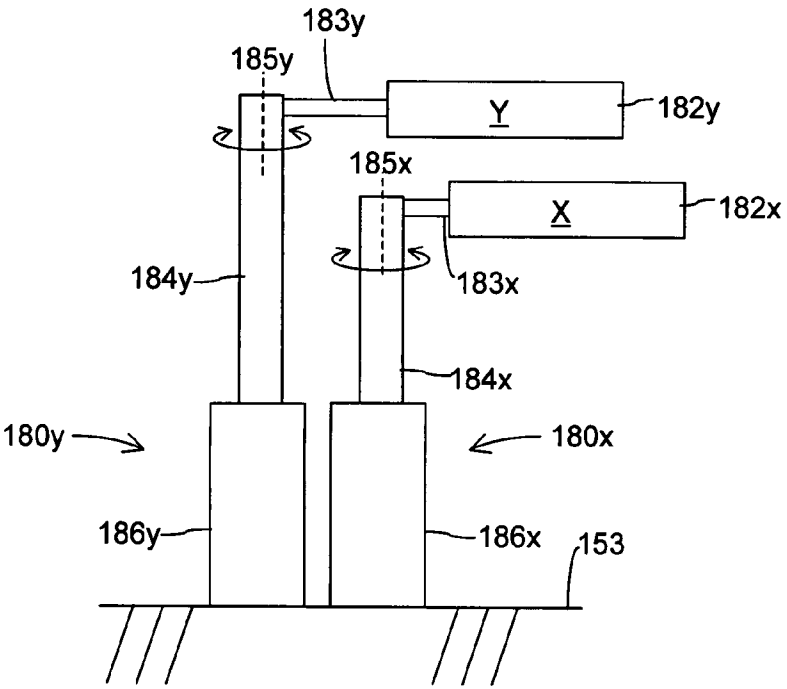

The first and second pivoting-and-vertical drive mechanism 186$x$ and 186$y$ of the wafer relay devices 180$x$ and 180$y$ can be mounted to the upper housing surface 152 of the polishing unit 150 as illustrated in FIGS. 2 and 3. In an alternative embodiment, as illustrated in FIG. 10($a$), the first and second pivoting-and-vertical drive mechanism 186$x$ and 186$y$ are mounted to a lower surface 153 of the housing of the polishing unit 150. The lower housing surface 153 is positioned below the polishing tables 156$a$ and 156$b$ (not shown in FIG. 10($a$)). In another alternative embodiment, as illustrated in FIG. 10($b$), the first pivoting-and-vertical drive mechanism 186$x$ is mounted to the upper housing surface 152 of the polishing unit 150 and the second pivoting-and-vertical mechanism 186$y$ is mounted to the lower housing surface 153 of the polishing unit. In this alternative embodiment, the wafer relay devices 180$x$ and 180$y$ can be designed and positioned such that the pivoting axis 185$x$ of the first wafer relay device 180$x$ coincides with the pivoting axis 185$y$ of the second wafer relay device 180$y$.

Figure 4:
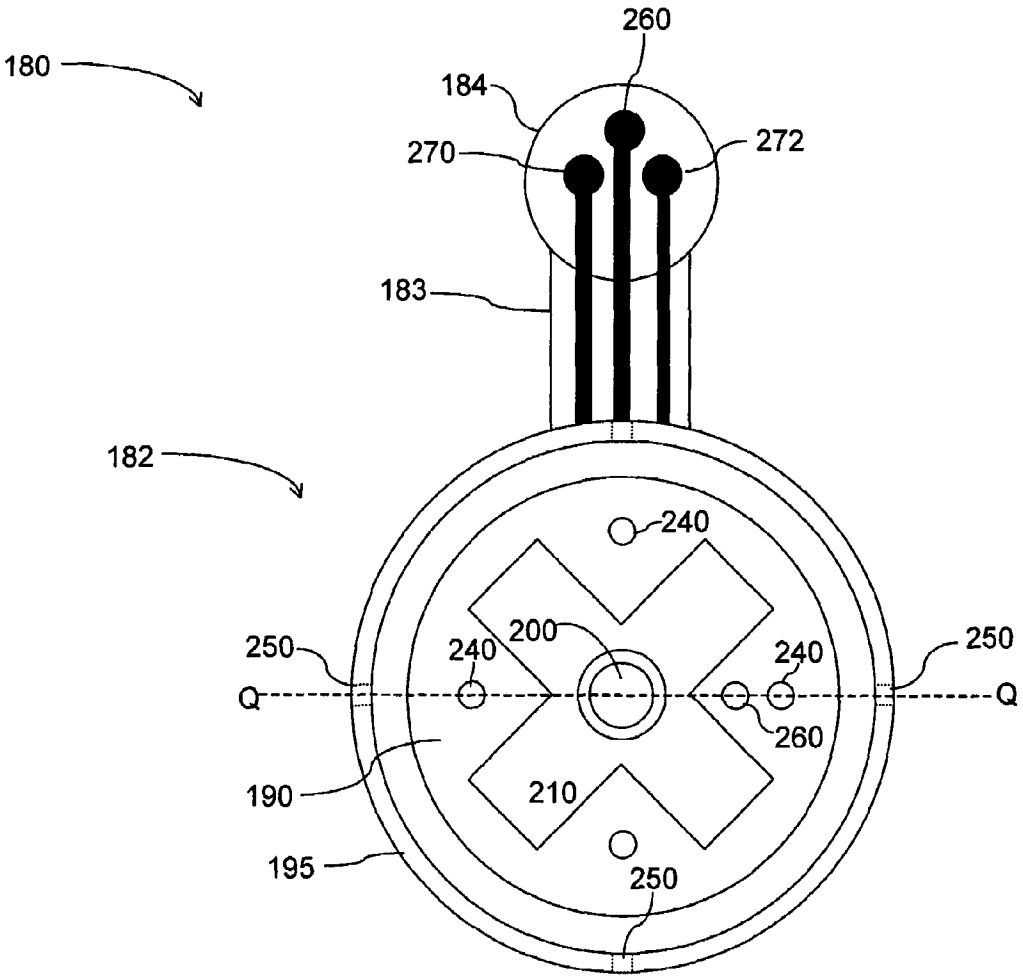
FIG. 4 is a top view of a load/unload cup of a wafer relay device in accordance with an embodiment of the invention.
Figure 5:
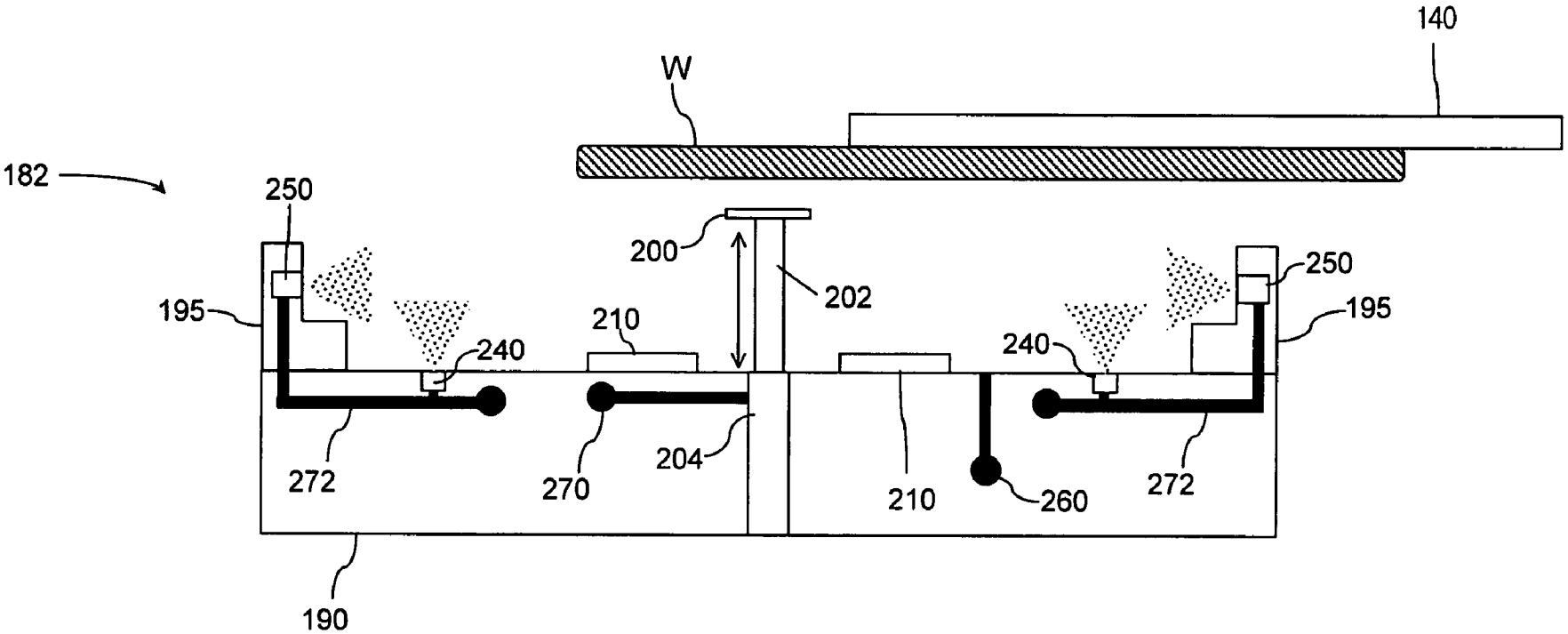
FIG. 5 is a cross-sectional view of the load/unload cup of FIG. 4.

With reference to FIGS. 4 and 5, a load/unload cup 182 of a wafer relay device 180, which can be either the wafer relay device 180$x$ or the wafer relay device 180$y$ of the polishing unit 150, in accordance with an embodiment of the invention is described. FIG. 4 is a top view of the load/unload cup 182 and FIG. 5 is a cross-sectional view of the load/unload cup 182 of FIG. 4 along the line QQ. The load/unload cup 182 may comprise a cup base 190, a cup ring 195, a lifter 200, a wafer tray 210, first multiple nozzles 240, second multiple nozzles 250, a drain channel 260, a first fluid channel 270 and a second fluid channel 272. The fluid channels 270 and 272 may be connected to fluid sources (not shown) through the pivoting arm 183 and the pivoting shaft 184. The drain channel 260 may be connected to a drain pump (not shown) through the pivoting arm 183 and the pivoting shaft 184, similar to the fluid channels 270 and 272.

The cup ring 195 and the wafer tray 210 are mounted on the cup base 190. The wafer tray 210 comprises a hole at the center such that the lifter 200 can be positioned at the center of the cup base 190. The lifter 200 is connected to a lifter pneumatic cylinder 204 through a lift piston 202 as illustrated in FIG. 5, which is a cross-sectional view of the load/unload cup 182. The lifter 200 is a wafer handling device to raise and lower a wafer to and from a wafer carrier, such as the wafer carrier 162$a$ or 162$b$ of the polishing unit 150. The lifter 200 is preferably made of soft materials such as rubber to avoid damaging wafer surface. The lifter 200 has a surface area that is smaller than the surface area of the wafer being handled by the lifter. The lifter cylinder 204 is connected to the first fluid channel 270 and operated by a fluid supplied through the first fluid channel 270. Nitrogen gas is one example of the fluid that can be used. The lifter 200 is moved up and down by the lifter cylinder 204. The lifter 200 is lifted above the top surface of the cup ring 195 to receive a wafer W from the wafer transport device 140 as illustrated in FIG. 5. After the lifter 200 receives the wafer W, the lifter is moved down below the wafer tray 210 in order to put the wafer W on the wafer tray 210.

The first multiple nozzles 240 are mounted on the top of the cup base 190 and the second multiple nozzles 250 are mounted on the interior side of the cup ring 195, as illustrated in FIG. 5. The first and second nozzles 240 and 250 are connected to the second fluid channel 272 and spray fluid, such as deionized (D.I.) water, which is supplied through the second fluid channel 272. Used fluid, e.g., used D.I. water, is drained through the drain channel 260 by the drain pump (not shown).

Figure 6A:
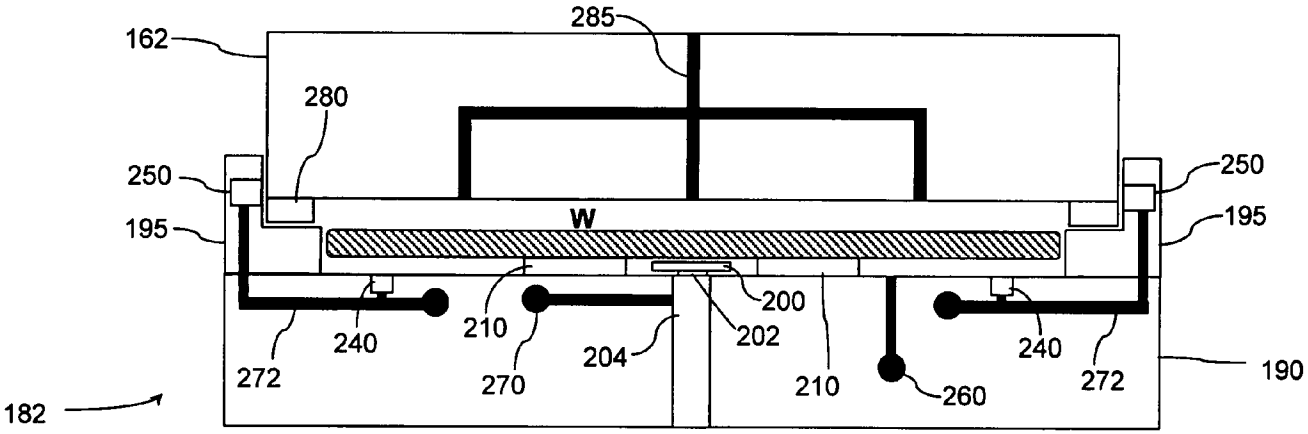
FIGS. 6(*a*) and 6(*b*) are sequential cross-sectional views of the load/unload cup of FIG. 4 to show a sequence of loading a wafer W onto a wafer carrier in accordance with an embodiment of the invention.
Figure 6B:
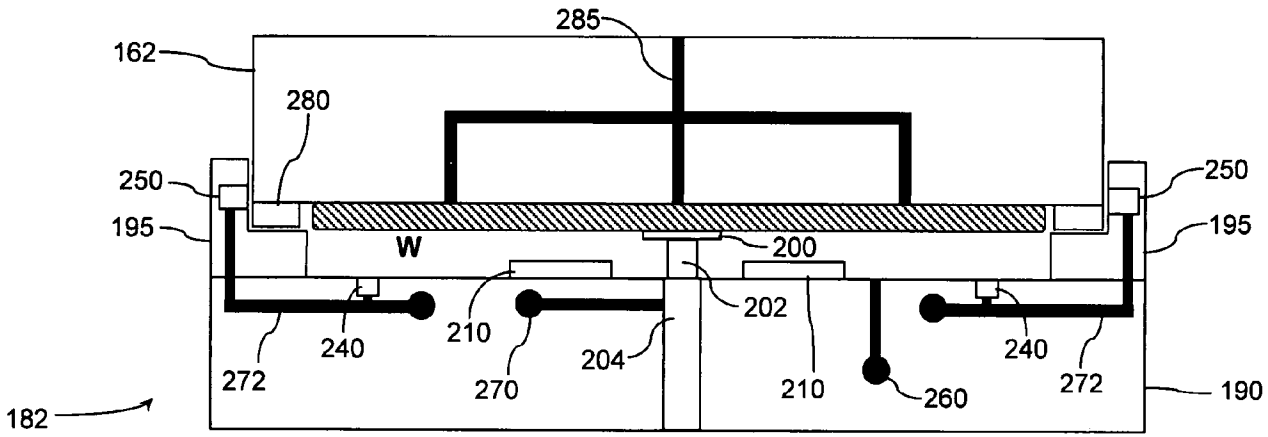
Figure 7A:
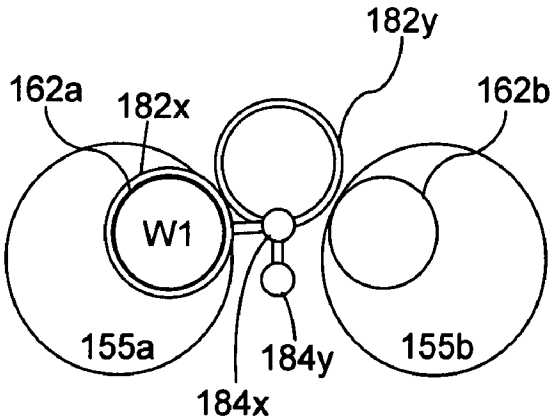
FIGS. 7(*a*)-7(*h*) are sequential top views of the polishing unit of the polishing apparatus of FIG. 1 to show a process sequence in the polishing unit in accordance with an embodiment of the invention.
Figure 7B:
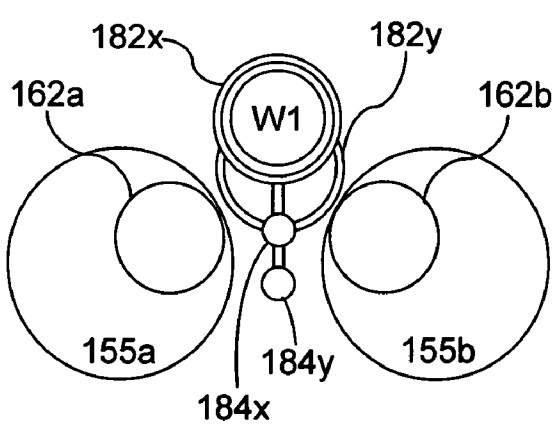
Figure 7C:
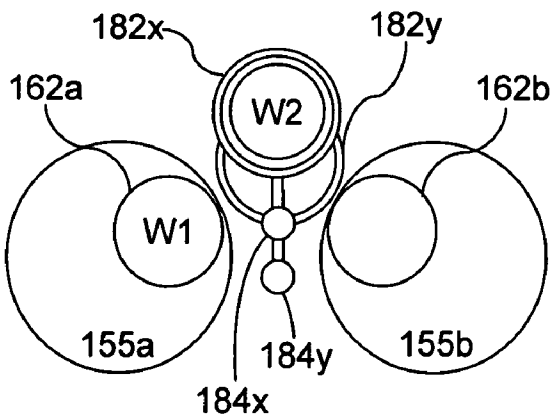
Figure 7D:
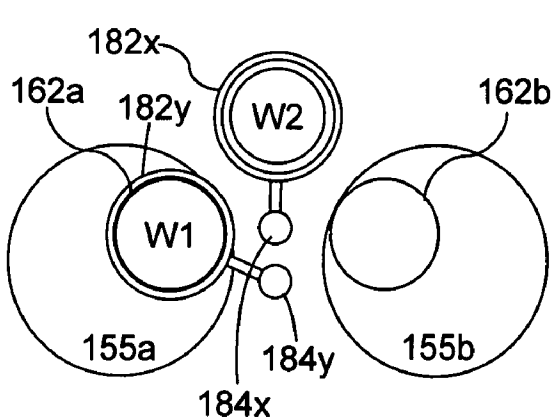
Figure 7F:
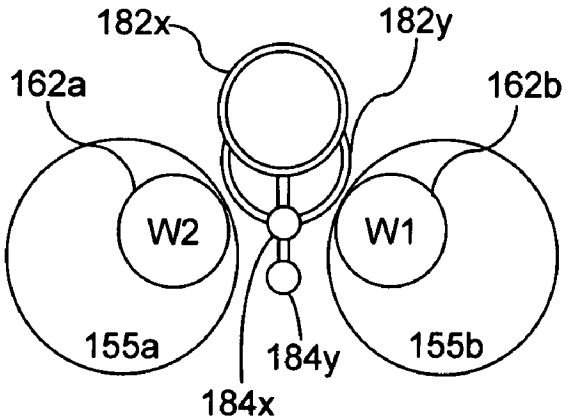
Figure 7E:
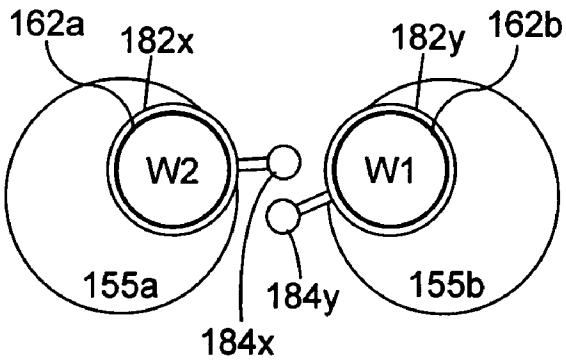
Figure 7H:
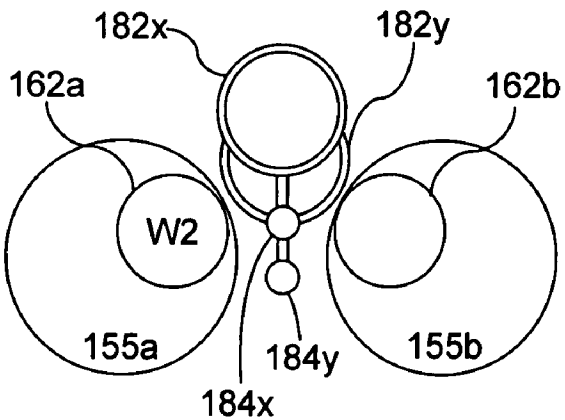
Figure 7G:
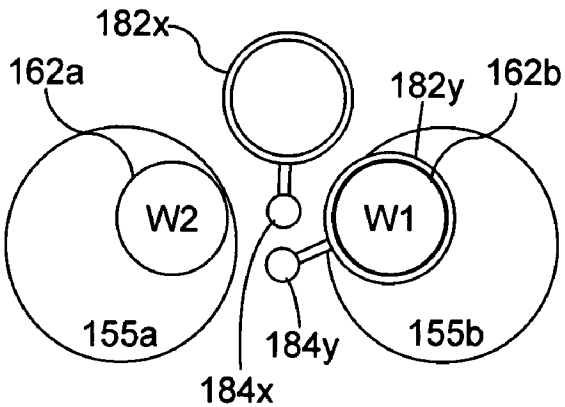

With reference to FIGS. 6($a$) and 6($b$), a process sequence for loading a wafer W onto a wafer carrier 162, which can be the wafer carrier 162$a$ or 162$b$, using the load/unload cup 182 of FIG. 4 in accordance with an embodiment of the invention is described. FIGS. 6($a$) and ($b$) are sequential cross-sectional views of the load/unload cup 182 of FIG. 4. After the wafer W is positioned on the wafer tray 210 as previously described with reference to FIG. 5, the load/unload cup 182 is transferred to a position where the wafer carrier 162 is positioned, as illustrated in FIG. 6($a$). The wafer carrier 162 comprises a retainer ring 280 to confine the wafer W during polishing process. Next, the lifter 200 is moved up and the wafer W on the lifter is received by the wafer carrier 162 using a vacuum supplied through vacuum channels 285, as illustrated in FIG. 6($b$). After the wafer W is received by the wafer carrier 162, the lifter 200 is moved down. For unloading the wafer W, the vacuum provided through the vacuum channels 285 is removed, which releases the wafer W from the wafer carrier 162 onto the lifter 200 of the load/unload cup 182. The load/unload cup 182 can wash the wafer carrier 162 by spraying D.I. water onto the wafer carrier 162.

Even though a specific configuration of the load/unload cup 182 and its wafer loading/unloading process have been described, any type of device that can load and unload wafers onto and from the wafer carrier 162 can be used in the wafer relay device 180, and thus, in the wafer relay devices 180$x$ and 180$y$ of the polishing unit 150.

With reference to FIGS. 7($a$)-($h$), an exemplary process sequence of wafer transferring and polishing at the polishing unit 150 of the polishing apparatus 100 is described. FIGS. 7($a$)-($h$) are sequential perspective views of the polishing unit 150 to show the process sequence.

In FIG. 7($a$), the two wafer carriers 162$a$ and 162$b$ are positioned at the respective wafer load/unload positions over the respective polishing pads 155$a$ and 155$b$. The two load/unload cups 182$x$ and 182$y$ are positioned at the respective parking positions, X and Y (not indicated in FIGS. 7($a$)-7($h$)). A first wafer W1 is supplied to the first load/unload cup 182$x$ by the wafer transport device 140 (not shown in FIGS. 7($a$)-7($h$)).

In FIG. 7($b$), the first load/unload cup 182$x$ is transferred to the wafer load/unload position of the first wafer carrier 162$a$ and the first wafer W1 is loaded onto the first wafer carrier 162$a$.

In FIG. 7($c$), the first load/unload cup 182$x$ is transferred back to the parking position X and the first wafer W1 is polished on the polishing pad 155$a$ using a first kind of slurry by the first wafer carrier 162$a$. While the first wafer W1 is being polished, a second wafer W2 is supplied to the first load/unload cup 182$x$ by the wafer transport device 140.

In FIG. 7(*d*), after the polishing process of the first wafer W1 is completed, the first wafer carrier 162*a* is lifted from the polishing pad 155*a* and then transferred back to the wafer load/unload position. The second load/unload cup 182*y* is then transferred to the wafer load/unload position of the first wafer carrier 162*a*, where the first wafer W1 is unloaded from the first wafer carrier 162*a* onto the second load/unload cup.

In FIG. 7(*e*), the second load/unload cup 182*y* is transferred to the wafer load/unload position of the second wafer carrier 162*b* and then the first wafer W1 is loaded onto the second wafer carrier 162*b*. During the transferring process, the first wafer W1 can be washed on the second load/unload cup 182*y* by D.I. water or chemicals such as BTA supplied through the nozzles 240 and 250 (not shown in FIG. 7(*e*)) of the second load/unload cup 182*y*. After the second load/unload cup 182*y* is transferred from the first wafer carrier 162*a*, the first load/unload cup 182*x* is transferred to the first carrier 162*a* and then the second wafer W2 is loaded onto the first wafer carrier 162*a*.

In FIG. 7(*f*), the load/unload cups 182*x* and 182*y* are transferred back to the respective parking positions X and Y. Furthermore, the second wafer W2 is polished on the polishing pad 155*a* using the first kind of slurry by the first wafer carrier 162*a*. In addition, the first wafer W1 is polished on the polishing pad 155*b* using either the first kind of slurry or a second kind of slurry by the second wafer carrier 162*b*.

In FIG. 7(*g*), after the polishing process of the first wafer W1 is completed, the second wafer carrier 162*b* is lifted from the polishing pad 155*b* and then transferred back to its wafer load/unload position. The second load/unload cup 182*y* is transferred to the wafer load/unload position of the second wafer carrier 162*b*, where the second wafer W2 is unloaded from the second wafer carrier 162*a* onto the second load/unload cup 182*y*.

In FIG. 7(*h*), the second load/unload cup 182*y* is transferred back to the parking position Y and then the first wafer W1 is removed from the second load/unload cup 182*y* by the wafer transport device 140. During the transferring process, the first wafer W1 can be washed on the second load/unload cup 182*y* by D.I. water or chemicals such as BTA supplied through the nozzles 240 and 250 (not shown in FIG. 7(*h*)) of the second load/unload cup 182*y*. The process then continues for the second wafer W2 in a similar manner.

The exemplary sequence described above can be used for Cu damascene CMP process by polishing Cu film of the semiconductor wafers on the first polishing pad 155*a* and then polishing barrier metal of the semiconductor wafers on the second pad 155*b*.

Even though one exemplary sequence of transferring and polishing semiconductor wafers in the polishing unit 150 has been described with reference to FIGS. 7(*a*)-7(*h*), other sequences may be also used in the polishing unit 150. As an example, instead of using the second load/unload cup 182*y* to transfer the first wafer W1 from the first wafer carrier 162*a* to the second wafer carrier 162*b*, the first load/unload cup 182*x* can be used. Consequently, in this example, the second load/unload cup 182*y* is used to receive the second wafer W2 and to transfer the second wafer W2 to the first wafer carrier 162*a*. As another example, instead of using the second load/unload cup 182*y* to transfer the first wafer W1 from the second wafer carrier 162*b*, the first load/unload cup 182*x* can be used. In another example, instead of using the second load/unload cup 182*y* to transfer the first wafer W1 from the first wafer carrier 162*a* to the second wafer carrier 162*b* and to transfer the first wafer W1 from the second wafer carrier 162*b*, the first load/unload cup 182*x* can be used to perform both of these tasks. Thus, each of the first and second load/unload cups 182*x* and 182*y* can be used to load semiconductor wafers onto one or both of the first and second wafer carriers 162*a* and 162*b* and/or to unload semiconductor wafer from one or both of the first and second wafer carriers.

Figure 8:
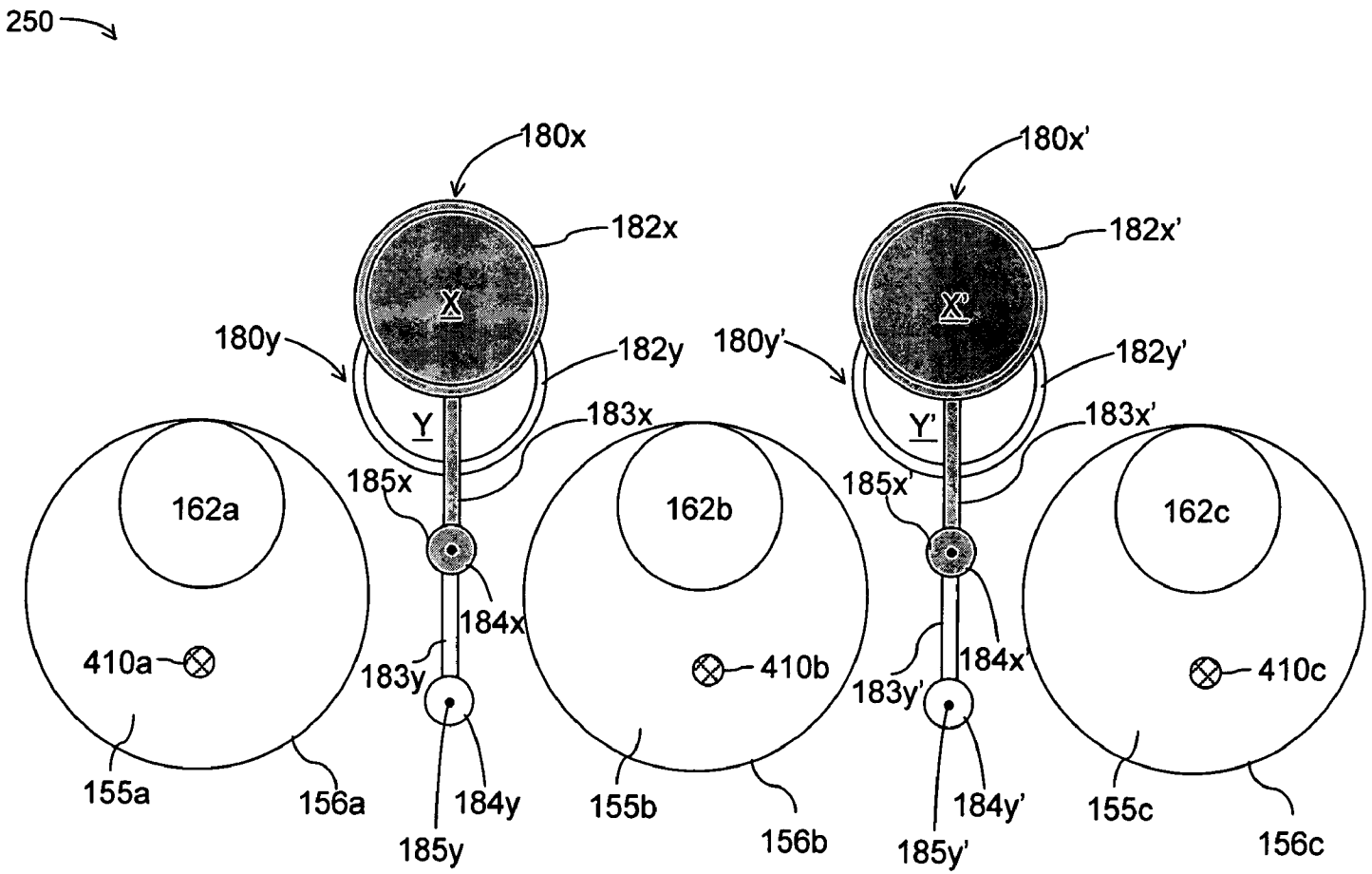
FIG. 8 is a top view of a polishing unit, which can replace the polishing unit of the polishing apparatus of FIG. 1, in accordance with another embodiment of the present invention.

With reference to FIG. 8, a polishing unit 250 according to another embodiment of the present invention is described. FIG. 8 is a top view of the polishing unit 250. In FIG. 8, the same reference numbers used in FIG. 1 will be used to identify similar elements. The polishing unit 250 can be used in the polishing apparatus 100 of FIG. 1 instead of the polishing unit 150. The polishing unit 250 includes all the components of the polishing unit 150. However, the polishing unit 250 further includes a third wafer carrier 162*c*, a third polishing table 156*c*, a third wafer relay device 180*x*' and a fourth wafer relay device 180*y*'. The third wafer carrier 162*c* is positioned over the third polishing table 156*c* and polishes wafers on the third polishing table 156*c* using a polishing pad 155*c*. The polishing unit 250 also includes a third pad conditioner 410*c*, which is used to condition the surface of the polishing pad 155*c*.

In FIG. 8, the wafer carriers 162*a*, 162*b* and 162*c* are illustrated without the associated carrier shafts 164 and rotating-and-vertical drive mechanisms 166. However, each of the wafer carriers 162*a*, 162*b* and 162*c* of the polishing unit 250 is a part of a wafer carrier assembly, as described above with reference to FIGS. 1 and 2. In FIG. 8, the wafer relay devices 180*x*, 180*y*, 180*x*' and 180*y*' are shown without the associated pivoting-and-vertical drive mechanisms 186. However, each load/unload cup 182 of the wafer relay devices 180*x*, 180*y*, 180*x*' and 180*y*' is controlled by the respective pivoting-and-vertical drive mechanism 186 as described above with reference to FIGS. 1, 2 and 3.

In FIG. 8, the positions X' and Y' of the third and fourth load/unload cups 182*x*' and 182*y*' are their respective parking positions. The load/unload cup 182*x*' can be pivoted about a pivoting point 185*x*' from the parking position X' to one or both of the wafer load/unload positions of the second and third wafer carriers 162*b* and 162*c* by its pivoting motions. Similarly, the load/unload cup 182*y*' can be pivoted about a pivoting point 185*y*' from the parking position Y' to one or both of the wafer load/unload positions of the second and third wafer carriers 162*b* and 162*b* by its pivoting motions. As shown in FIG. 8, the pivoting axes 185*x*' and 185*y*' of the wafer relay devices 180*x*' and 180*y*', respectively, are located between the polishing tables 156*b* and 156*c* and between the wafer carriers 162*b* and 162*c*.

To horizontally align the load/unload cup 182*x*' to one of the second and third wafer carriers 162*b* and 162*c* for wafer load/unload, the third wafer relay device 180*x*' is designed and positioned in such a manner that the distance from the center of its pivoting shaft 184*x*', i.e., the pivoting axis 185*x*', to the center of its load/unload cup 182*x*' is substantially equal to the distances from the pivoting shaft 184*x*' to the centers of the second and third wafer carriers 162*b* and 162*c*. In a similar manner, the fourth wafer relay device 180*y*' is designed and positioned in such a manner that the distance from its pivoting shaft 184*y*' to the center of its load/unload cup 182*y*' is substantially equal to the distances from the pivoting shaft 184*y*' to the centers of the second and third wafer carriers 162*b* and 162*c*. Furthermore, the load/unload cups 182*x*' and 182*y*' can be vertically aligned to the wafer carriers 162*b* and 162*c* at the wafer load/unload positions for loading and unloading of semiconductor wafers by vertical motions of the load/unload cups 182*x*' and 182*y*'. It is also possible to vertically align the wafer carriers 162*b* and 162*c* to the load/unload cups 182*x*' and 182*y*' by vertical motions of the wafer carriers 162*b* and 162*c*.

The two wafer relay devices 180*x*' and 180*y*' can be positioned between the two wafer carriers 162*b* and 162*c* such that the load/unload cup 182*x*' is positioned over the load/unload cup 182*y*' at their respective parking positions X' and Y' as illustrated in FIG. 8. The wafer transport device 140 (not shown in FIG. 8) transports wafers to and from the load/unload cups 182*x*' and 182*y*' at these parking positions X' and Y'.

In a mixed mode operation of the polishing unit 250, a first group of wafers is processed using the first and second wafer carriers 162*a* and 162*b*, the first and second polishing tables 156*a* and 156*b* and the first and second wafer relay devices 180*x* and 180*y* according to one of the process sequences described above with respect to the polishing unit 150. Furthermore, a second group of wafers is processed using the second and third wafer carriers 162*b* and 162*c*, the second and third polishing tables 156 and 156*c* and the third and fourth wafer relay devices 180*x*' and 180*y*'.

In order to process the second group of wafers in the polishing unit 250, each wafer of the second group is transferred to the third wafer carrier 162*c* by one of the wafer relay devices 180*x*' and 180*y*' and then polished on the third polishing table 156*c* using the polishing pad 155*c*. Next, the wafer is transferred to the second wafer carrier 162*b* by one of the wafer relay devices 180*x*' and 180*y*' and then further polished on the second polishing table 156*b* using the polishing pad 155*b*. Next, the wafer is removed from the second wafer carrier 162*b* by one of the wafer relay devices 180*x*' and 180*y*'.

It is also possible to transfer each wafer of the second group first to the second wafer carrier 162*b* by one of the wafer relay devices 180*x*' and 180*y*', polish the wafer on the second polishing table 156*b* using the polishing pad 155*b*, transfer the wafer from the second wafer carrier 162*b* to the third wafer carrier 162*c* by one of the wafer relay devices 180*x*' and 180*y*', further polish the wafer on the third polishing table 156*c* using the polishing pad 155*c*, and then remove the wafer from the third wafer carrier 162*c* by one of the wafer relay devices 180*x*' and 180*y*'.

When a wafer of the first group and a wafer of the second group are transferred to the second wafer carrier 162*b* to be polished on the second polishing table 156*b* using the polishing pad 155*b*, these wafers are transferred to the second wafer carrier 162*b* in an alternating manner such that the second wafer carrier 162*b* polish a first wafer of the first group, a first wafer of the second group, a second wafer of the first group, a second wafer of the second group, and so on.

In a parallel mode operation of the polishing unit 250, a first group of wafers is processed using the first wafer carrier 162*a*, the first polishing table 156*a* and the first and second wafer relay devices 180*x* and 180*y*. A second group of wafers is processed using the second wafer carrier 162*b*, the second polishing table 156*b* and the first and second wafer relay devices 180*x* and 180*y*. A third group of wafers is processed using the third wafer carrier 162*c*, the third polishing table 156*c* and the third and fourth wafer relay devices 180*x*' and 180*y*'.

In order to process the first group of wafers in the polishing unit 250, each wafer of the first group is transferred to the first wafer carrier 162*a* by one of the wafer relay devices 180*x* and 180*y* and then polished on the first polishing table 156*a* using the polishing pad 155*a*. Next, the wafer is removed from the first wafer carrier 162*a* by one of the wafer relay devices 180*x* and 180*y*.

In order to process the second group of wafers in the polishing unit 250, each wafer of the second group is transferred to the second wafer carrier 162*b* by one of the wafer relay devices 180*x* and 180*y* and then polished on the second polishing table 156*b* using the polishing pad 155*b*. Next, the wafer is removed from the second wafer carrier 162*b* by one of the wafer relay devices 180*x* and 180*y*.

In order to process the third group of wafers in the polishing unit 250, each wafer of the third group is transferred to the third wafer carrier 162*c* by one of the wafer relay devices 180*x*' and 180*y*' and then polished on the third polishing table 156*c* using the polishing pad 155*c*. Next, the wafer is removed from the third wafer carrier 162*c* by one of the wafer relay devices 180*x*' and 180*y*'.

Figure 9:
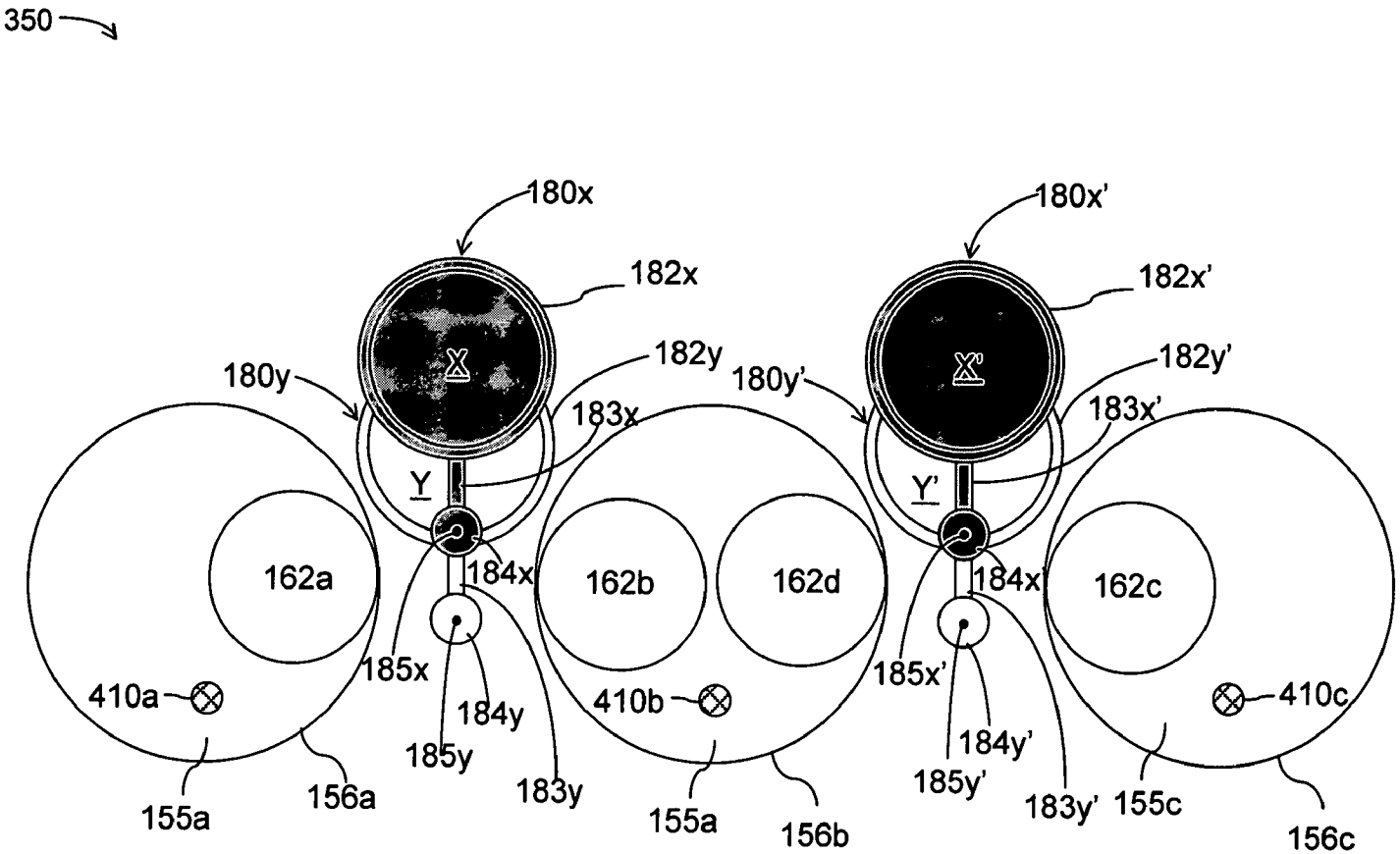
FIG. 9 is a top view of a polishing unit, which can replace the polishing unit of the polishing apparatus of FIG. 1, in accordance with another embodiment of the present invention.

With reference to FIG. 9, a polishing unit 350 according to another embodiment of the present invention is described. FIG. 9 is a top view of the polishing unit 350. The polishing unit 350 can be used in the polishing apparatus 100 of FIG. 1 instead of the polishing unit 150. The polishing unit 350 includes all the components of the polishing unit 250. However, the polishing unit 350 further includes a fourth wafer carrier 162*d* positioned over the second polishing table 156*b*. The fourth wafer carrier 162*d* polishes wafers on the second polishing table 156*b* using the polishing pad 155*b*. Therefore, the second and fourth wafer carriers 162*b* and 162*d* can polish two wafers simultaneously on the second polishing table 156*b*. In order to accommodate the additional wafer carrier 162*d* over the polishing table 156*b*, the wafer carriers 162 are positioned closer to adjacent wafer relay devices 180*x*, 180*y*, 180*x*' and 180*y*'. Furthermore, the pivoting shafts 183*x*, 183*y*, 183*x*' and 183*y* have been shortened.

In FIG. 9, the positions X' and Y' of the third and fourth load/unload cups 182*x*' and 182*y*' are their respective parking positions. The third load/unload cup 182*x*' can be pivoted from the parking position X' to one or both of the wafer load/unload positions of the third and fourth wafer carriers 162*c* and 162*d* by its pivoting motions. Similarly, the fourth load/unload cup 182*y*' can be pivoted from the parking position Y' to one or both of the wafer load/unload positions of the third and fourth wafer carriers 162*c* and 162*d* by its pivoting motions. As shown in FIG. 9, the pivoting axes 185*x*' and 185*y*' of the wafer relay devices 180*x*' and 180*y*', respectively, are located between the polishing tables 156*b* and 156*c* and between the wafer carriers 162*c* and 162*d*.

To horizontally align the load/unload cup 182*x*' to one of the third and fourth wafer carriers 162*c* and 162*d* for wafer load/unload, the third wafer relay device 180*x*' is designed and positioned in such a manner that the distance from the its pivoting shaft 184*x*', i.e., the pivoting axis 185*x*', to the center of its load/unload cup 182*x*' is substantially equal to the distances from the pivoting shaft 184*x*' to the centers of the third and fourth wafer carriers 162*c* and 162*d*. In a similar manner, the fourth wafer relay device 180*y*' is designed and positioned in such a manner that the distance from its pivoting shaft 184*y*', i.e., the pivoting axis 185*y*', to the center of its load/unload cup 182*y*' is substantially equal to the distances from the pivoting shaft 184*y*' to the centers of the third and fourth wafer carriers 162*c* and 162*d*. Furthermore, the load/unload cups 182*x*' and 182*y*' can be vertically aligned to the wafer carriers 162*c* and 162*d* at the wafer load/unload positions for loading and unloading of semiconductor wafers by vertical motions of the load/unload cups 182*x*' and 182*y*'. It is also possible to vertically align the wafer carriers 162*c* and 162*d* to the load/unload cups 182*x*' and 182*y*' by vertical motions of the wafer carriers 162*c* and 162*d*.

The two wafer relay devices 180*x*' and 180*y*' can be positioned between the two wafer carriers 162*c* and 162*d* such that the load/unload cup 182*x*' is positioned over the load/unload cup 182*y*' at their respective parking positions X' and Y' as illustrated in FIG. 9. The wafer transport device 140 (not shown in FIG. 9) transports wafers to and from the load/unload cups 182*x*' and 182*y*' at these parking positions X' and Y'.

In a mixed mode operation of the polishing unit 350, a first group of wafers is processed using the first and second wafer carriers 162*a* and 162*b*, the first and second polishing tables 156*a* and 156*b* and the first and second wafer relay devices 180*x* and 180*y* according to one of the process sequences described above with respect to the polishing unit 150. Furthermore, a second group of wafers is processed using the third and fourth wafer carriers 162*c* and 162*d*, the second and third polishing tables 156*b* and 156*c* and the third and fourth wafer relay devices 180*x*' and 180*y*'.

In order to process the second group of wafers in the polishing unit 250, each wafer of the second group is transferred to the third wafer carrier 162*c* by one of the wafer relay devices 180*x*' and 180*y*' and then polished on the third polishing table 156*c* using the polishing pad 155*c*. Next, the wafer is transferred from the third wafer carrier 162*c* to the fourth wafer carrier 162*d* by one of the wafer relay devices 180*x*' and 180*y*' and then further polished on the second polishing table 156*b* using the polishing pad 155*b*. Next, the wafer is removed from the fourth wafer carrier 162*d* by one of the wafer relay devices 180*x*' and 180*y*'.

It is also possible to transfer each wafer of the second group to the fourth wafer carrier 162*d* by one of the wafer relay devices 180*x*' and 180*y*', polish the wafer on the second polishing table 156*b* using the polishing pad 155*b*, transfer the wafer from the fourth wafer carrier 162*d* to the third wafer carrier 162*c* by one of the wafer relay devices 180*x*' and 180*y*', further polish the wafer on the third polishing table 156*c* using the polishing pad 155*c*, and then remove the wafer from the third wafer carrier 162*c* by one of the wafer relay devices 180*x*' and 180*y*'.

In a parallel mode operation of the polishing unit 350, a first group of wafers is processed using the first wafer carrier 162*a*, the first polishing table 156*a* and the first and second wafer relay devices 180*x* and 180*y*. A second group of wafers is processed using the second wafer carrier 162*b*, the second polishing table 156*b* and the first and second wafer relay devices 180*x* and 180*y*. A third group of wafers is processed using the fourth wafer carrier 162*d*, the second polishing table 156*b* and the third and fourth wafer relay devices 180*x*' and 180*y*'. A fourth group of wafers is processed using the third wafer carrier 162*c*, the third polishing table 156*c* and the third and fourth wafer relay devices 180*x*' and 180*y*'.

Figure 11:
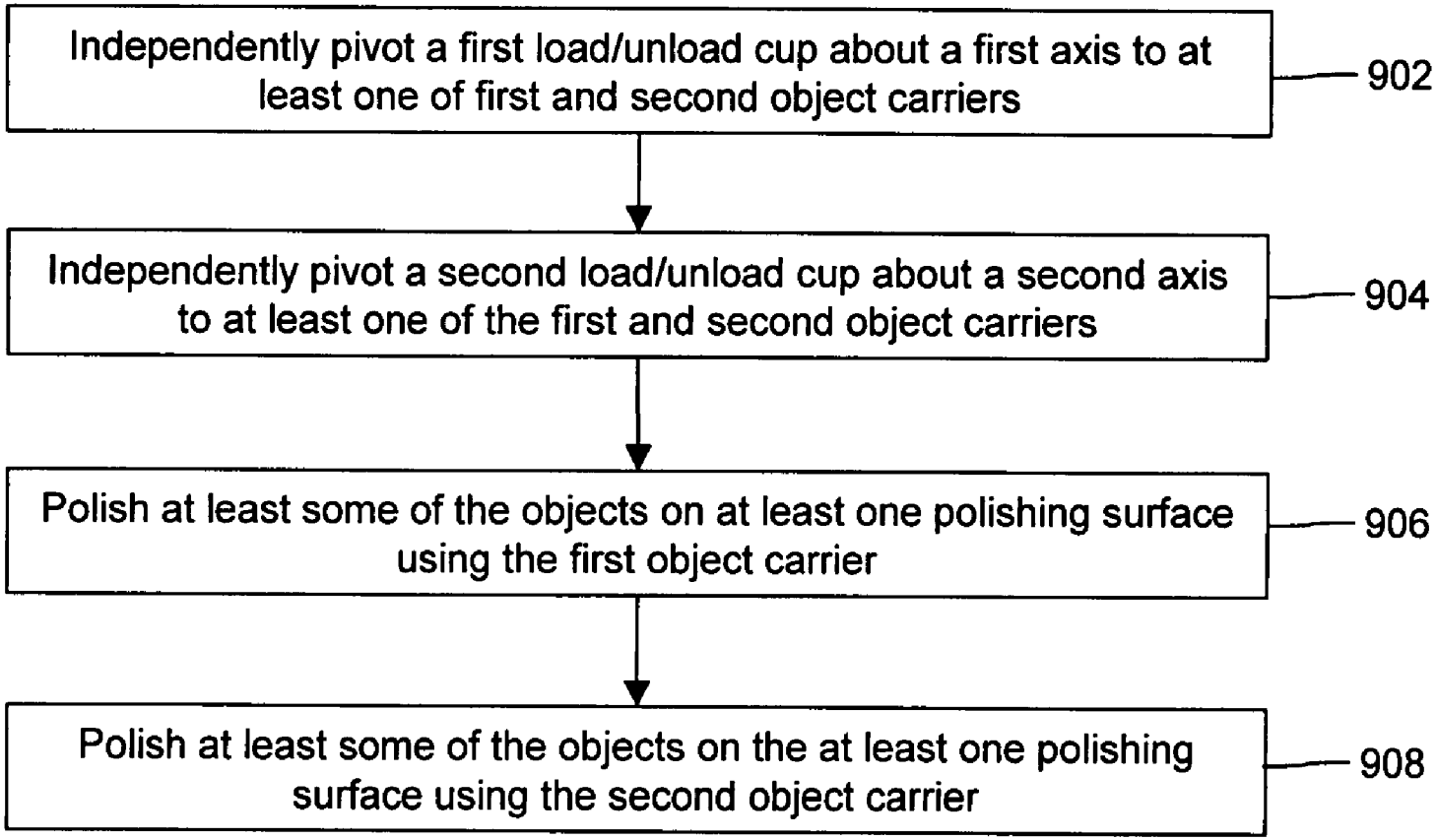
FIG. 11 is a flow diagram of a method for polishing objects, such as semiconductor wafers, in accordance with an embodiment of the invention.

A method for polishing objects, such as semiconductor wafers, in accordance with an embodiment of the invention is described with reference to the flow diagram of FIG. 11. At block 902, a first load/unload cup is independently pivoted about a first axis to at least one of first and second object carriers to transfer at least some of the objects between the first load/unload cup and at least one of the first and second object carriers. The first axis is located between the first and second object carriers. Next, at block 904, a second load/unload cup is independently pivoted about a second axis to at least one of the first and second object carriers to transfer at least some of the objects between the second load/unload cup and at least one of the first and second object carriers. The second axis is located between the first and second object carriers. Next, at block 906, at least some of the objects are polished on at least one polishing surface using the first object carrier. Next, at block 908, at least some of the objects are polished on the at least one polishing surface using the second object carrier.

Although specific embodiments of the invention have been described and illustrated, the invention is not to be limited to the specific forms or arrangements of parts so described and illustrated. The scope of the invention is to be defined by the claims appended hereto and their equivalents.

What is claimed is:

1. An apparatus for polishing objects, said apparatus comprising:

at least one polishing surface;

a first object carrier positioned over said at least one polishing surface;

a second object carrier positioned over said at least one polishing surface;

a first object relay device including a first load/unload cup configured to independently pivot said first load/unload cup about a first axis to at least one of said first and second object carriers to transfer at least some of said objects between said first load/unload cup and at least one of said first and second object carriers, said first axis being located between said first and second object carriers; and a second object relay device including a second load/unload cup configured to independently pivot said second load/unload cup about a second axis to at least one of said first and second object carriers to transfer at least some of said objects between said second load/unload cup and at least one of said first and second object carriers, said second axis being located between said first and second object carriers, wherein at least one of said first and second object relay devices is configured to pivot one of said first and second load/unload cups from said first object carrier to said second object carrier to transfer at least some of said objects from said first object carrier to said second object carriers.

2. The apparatus of claim 1 wherein said at least one polishing surface includes first and second polishing surfaces, said first object carrier being positioned over said first polishing surface, said second object carrier being positioned over said second polishing surface.

3. The apparatus of claim 1 wherein said first object relay device is configured to independently pivot said first load/unload cup on a first plane and wherein said second object relay device is configured to independently pivot said second load/unload cup on a second plane, said first and second planes being parallel to said at least one polishing surface, one of said first and second planes being closer to said at least one polishing surface than the other.

4. The apparatus of claim 1 wherein said first and second object relay devices are attached to an upper housing surface positioned above said at least one polishing surface.

5. The apparatus of claim 1 wherein said first and second object relay devices are attached to a lower housing surface positioned below said at least one polishing surface.

6. The apparatus of claim 1 wherein said first object relay device is attached to an upper housing surface positioned above said at least one polishing surface and wherein said second object relay device is attached to a lower housing surface positioned below said at least one polishing surface.

7. The apparatus of claim 6 wherein said first and second object relay devices are positioned such that said first axis of said first object relay device coincides with said second axis of said second object relay device.

8. The apparatus of claim 1 wherein said first object relay device is configured to move said first load/unload cup in a vertical direction and wherein said second relay device is configured to move said second load/unload cup in said vertical direction.

9. The apparatus of claim 1 further comprising an object transport device positioned to transport at least some of said objects to and from said first and second load/unload cups.

10. The apparatus of claim 1 further comprising:

a third object carrier positioned over said at least one polishing surface;

a third object relay device including a third load/unload cup configured to independently pivot said third load/unload cup about a third axis to at least one of said second and third object carriers to transfer at least some of said objects between said third load/unload cup and at least one of said second and third object carriers, said third axis being located between said second and third object carriers; and a fourth object relay device including a fourth load/unload cup configured to independently pivot said fourth load/unload cup about a fourth axis to at least one of said second and third object carriers to transfer at least some of said objects between said fourth load/unload cup and at least one of said second and third object carriers, said fourth axis being located between said second and third object carriers.

11. The apparatus of claim 1 further comprising:

a third object carrier positioned over said at least one polishing surface;

a fourth object carrier positioned over said at least one polishing surface;

a third object relay device including a third load/unload cup configured to independently pivot said third load/unload cup about a third axis to at least one of said third and fourth object carriers to transfer at least some of said objects between said third load/unload cup and at least one of said third and fourth object carriers, said third axis being located between said third and fourth object carriers; and a fourth object relay device including a fourth load/unload cup configured to independently pivot said fourth load/unload cup about a fourth axis to at least one of said third and fourth object carriers to transfer at least some of said objects between said fourth load/unload cup and at least one of said third and fourth object carriers, said fourth axis being located between said third and fourth object carriers.

12. A method for polishing objects, said method comprising:

independently pivoting a first load/unload cup about a first axis to at least one of first and second object carriers to transfer at least some of said objects between said first load/unload cup and at least one of said first and second object carriers, said first axis being located between said first and second object carriers;

independently pivoting a second load/unload cup about a second axis to at least one of first and second object carriers to transfer at least some of said objects between said second load/unload cup and at least one of said first and second object carriers, said second axis being located between said first and second object carriers;

polishing at least some of said objects on at least one polishing surface using said first object carrier;

polishing at least some of said objects on said at least one polishing surface using said second object carrier; and transferring at least some of said objects from said first object carrier to said second object carrier using said second load/unload cup.

13. The method of claim 12 wherein said polishing at least some of said objects on said at least one polishing surface using said first object carrier includes polishing at least some of said objects on a first polishing surface using said first object carrier and wherein said polishing at least some of said objects on said at least one polishing surface using said second object carrier includes polishing at least some of said objects on a second polishing surface using said second object carrier.

14. The method of claim 12 wherein said independently pivoting said first load/unload cup about said first axis includes independently pivoting said first load/unload cup about said first axis on a first plane and wherein independently pivoting said second load/unload cup about said second axis includes independently pivoting said second load/unload cup about said second axis on a second plane, said first and second planes being parallel to said at least one polishing surface, one of said first and second planes being closer to said at least one polishing surface than the other.

15. The method of claim 12 further comprising transporting at least some of said objects to and from said first and second load/unload cups using an object transport device.

16. The method of claim 12 wherein said independently pivoting said first load/unload cup includes transferring at least some of said objects to said first object carrier using said first load/unload cup and wherein said independently pivoting said second load/unload cup includes transferring at least some of said objects to said second object carrier using said second load/unload cup.

17. The method of claim 12 further comprising:

independently pivoting a third load/unload cup about a third axis to at least one of said second object carrier and a third object carrier to transfer at least some of said objects between said third load/unload cup and at least one of said second and third object carriers, said third axis being located between said second and third object carriers;

independently pivoting a fourth load/unload cup about a fourth axis to at least one of said second and third object carriers to transfer at least some of said objects between said fourth load/unload cup and at least one of said second and third object carriers, said fourth axis being located between said second and third object carriers; and polishing at least some of said objects on at least one polishing surface using said third object carrier.

18. The method of claim 12 wherein said polishing at least some of said objects on at least one polishing surface using said first object carrier includes polishing at least some of said objects on a first polishing surface using said first object carrier, wherein said polishing at least some of said objects on at least one polishing surface using said second object carrier includes polishing at least some of said objects on a second polishing surface using said second object carrier, and wherein said polishing at least some of said objects on at least one polishing surface using said third object carrier includes polishing at least some of said objects on a third polishing surface using said third object carrier.

19. The method of claim 12 further comprising:

independently pivoting a third load/unload cup about a third axis to at least one of third and fourth object carriers to transfer at least some of said objects between said third load/unload cup and at least one of said third and fourth object carriers, said third axis being located between said third and fourth object carriers;

independently pivoting a fourth load/unload cup about a fourth axis to at least one of said third and fourth object carriers to transfer at least some of said objects between said fourth load/unload cup and at least one of said third and fourth object carriers, said fourth axis being located between said third and fourth object carriers;

polishing at least some of said objects on at least one polishing surface using said third object carrier; and polishing at least some of said objects on at least one polishing surface using said fourth object carrier.

* * * * *